United States Patent [19]

Peters

[11] 3,962,695

[45] June 8, 1976

[54] MAGNETIC KEY LOCK AND ALARM

[75] Inventor: George Peters, Brooklyn, N.Y.

[73] Assignee: Lawrence Peska Associates, Inc., New York, N.Y. ; a part interest

[22] Filed: July 3, 1975

[21] Appl. No.: 592,828

[52] U.S. Cl. ..... 340/274 R; 200/61.66

[51] Int. Cl.[2] ..... E05B 45/10

[58] Field of Search ..... 340/274 R; 200/61.66, 200/61.93

[56] References Cited

UNITED STATES PATENTS

| | | | |
|---|---|---|---|
| 2,767,278 | 10/1956 | Collins | 340/274 R |
| 3,705,369 | 12/1972 | Schwendeman, Jr. | 200/61.66 |
| 3,733,862 | 5/1973 | Killmeyer | 340/274 R |

*Primary Examiner*—Glen R. Swann, III

*Attorney, Agent, or Firm*—Jack D. Slobod

[57] ABSTRACT

A door lock carries an alarm and battery. The lock includes a tumbler system for cooperating with a serrated key. At the rear end of the key slot are located a pair of switches. One switch is normally open and is closed by the insertion of the key. The other switch is normally closed and includes a mass of iron on the switch wiper to be attracted by a magnet embedded in the key for opening the switch. The alarm, battery and switches are connected in a series circuit to cause the alarm to sound when a nonmagnet-bearing key is inserted in the key slot.

3 Claims, 5 Drawing Figures

MAGNETIC KEY LOCK AND ALARM

FIELD OF THE INVENTION

The present invention relates to a combined lock and alarm responsive to a magnet-bearing key. In its particular aspects the present invention relates to the provision of a key detection sensor and a magnetically actuatable switch within a lock mechanism.

BACKGROUND OF THE INVENTION

Various combined door locks and alarms have heretofore been devised for sounding an alarm in response to an attempt to open a lock with an improper key. Illustrative in this regard is U.S. Pat. No. 2,563,727 to Kempf. Such devices have not gained any appreciable acceptance for use in ordinary residences because of their expense. Further such devices have typically required highly unusual keys for which blanks are not readily available making it difficult to obtain duplicate keys.

OBJECTS OF THE INVENTION

It is an object of the present invention to provide an alarm system and door lock responsive to a readily modified key blank.

It is a further object of the present invention to provide an alarm system responsive to a magnet-bearing and serrated key for sounding an alarm when a properly serrated non-magnet-bearing key is inserted in a lock.

SUMMARY OF THE INVENTION

Briefly, the aforementioned and other objects of the present invention are satisfied by providing a door lock and alarm responsive to a common serrated key which is modified by embedding a small magnet therein.

The door lock includes the usual tumbler assembly for actuating the door bolt in response to rotation of the key. However, in addition a pair of switches are provided communicating with the key slot. One switch operates as a feeler to detect the insertion of a key or other tool into the key slot. The other switch has a mass of ferromagnetic material on the switch wiper for actuating the switch to an open condition upon attraction of the ferromagnetic material by a magnet-bearing key.

The switches are wired to an alarm buzzer and battery carried by the lock for sounding the alarm upon insertion of a non-magnet-bearing key into a key slot.

Thus, the frequent robberies which are executed by making a surreptitious impression of a key would be thwarted, because a duplicate key manufactured by a criminal would not include the small magnetic insert.

BRIEF DESCRIPTION OF THE DRAWINGS

Other objects, features and advantages of the present invention will become apparent upon perusal of the following detailed description of the preferred embodiment thereof when taken in conjunction with the appended drawing wherein.

DETAILED DESCRIPTION

Figure 1:
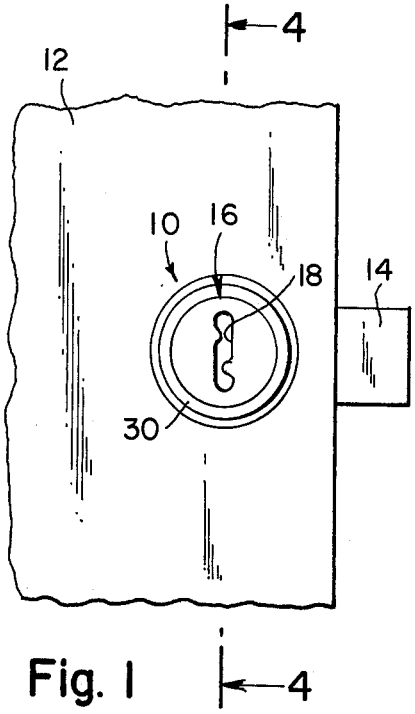
FIG. 1 is a front elevation view of a portion of the outside of a door with the lock of the present invention installed therein.

Referring to FIGS. 1 through 5 of the drawing the lock and alarm device 10, of the present invention is shown mounted through a door 12. The lock 10 which appears as a common cylinder lock, as viewed from the outside of door 12, as shown in FIG. 1, controls a bolt 14.

Figure 2:
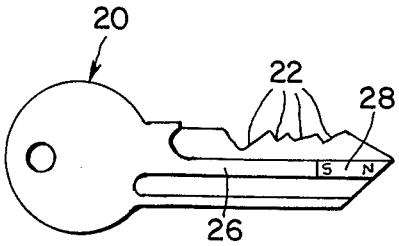
FIG. 2 is a side view of a key for use with the lock of the present invention.
Figure 3:
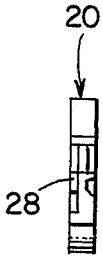
FIG. 3 is an end view of the key in FIG. 2.
Figure 4:
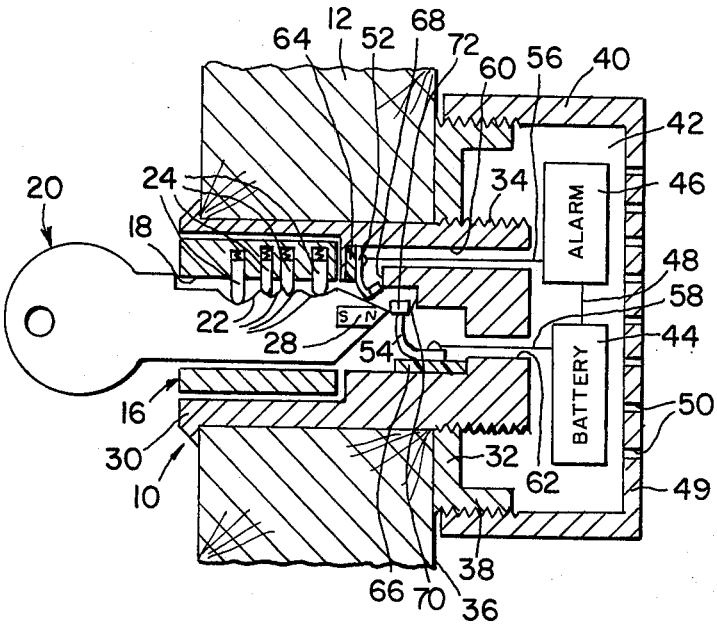
FIG. 4 is a cross-sectional side view of the lock, along the lines 4—4 of FIG. 1 with the key of FIG. 2 inserted therein.
Figure 5:
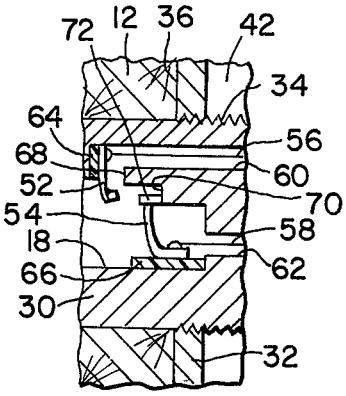
FIG. 5 is a partial view of FIG. 4, showing the condition of various operative parts when the key is not inserted therein.

The lock 10 includes a cylindrical tumbler assembly 16 defining a key slot 18. As shown in FIGS. 2 through 4, a key 20, appearing generally as a common key, has the usual serrations 22 along one edge for cooperating with the elements 24 of tumbler assembly 16 for translating bolt 14 upon rotation of key 20 within key slot 18.

In contradistinction to the usual key blank, key 20 is modified by grinding off the end of the generally central ridge 26 running the length of the operative portion of the key and replacing that end portion with a small elongated axially polarized magnet 28 adhesively secured to key 20 to complete ridge 26. Thus, the end of key 20 comprises magnet 28 which is oriented to create a magnetic field axially of the key. It should be apparent that a common key is readily modified to incorporate magnet 28.

The lock 10, comprises a cylindrical metal body 30 retaining tumbler mechanism 16 at a front end. Lock body 30 is extended at its rear end beyond the thickness of door 12 and receives an internally threaded spanner nut 32 engaged on threads 34 on the protruding portion of body 30 which bears against the inside surface 36 of door 12 retaining lock body 30 in the door. Spanner nut 32 has an axially extending lip 38 on the circular periphery of the nut 32. Lip 38 is externally threaded and receives a circular end cap 40 which defines a cylindrical chamber 42 enclosed generally by the spanner nut 32, and cap 40.

Chamber 42 comprises a holder for a battery 44 and an electrically actuatable alarm 46, such as a buzzer, which are connected in series by a lead 48. For enabling alarm 46 to be heard, the circular end wall 50 of cap 40 includes perforations 50.

The circuit from the battery 44 to alarm 46 is controlled by a pair of switch wiper elements 52 and 54 within body portion 30, which are respectively connected to the alarm and the battery by leads 56 and 58 which are brought to chamber 42 via a pair of longitudinal bores 60 and 62 in body portion 30.

Switch wiper elements 52 and 54 are resilient metal strips which are respectively mounted on insulating pads 64 and 66 and project into key slot 18 to coact with integral steps 68 and 70 in metal body portion 30. Wiper element 52 and step 68 comprise a normally open switch. When key 20 is fully inserted into key slot 18, the wiper element 52 which projects vertically downward into the slot is driven against the step 68 behind the wiper by the end of key 20. Thus wiper 52 serves as a detector of the presence of a key in slot 18.

The wiper element 54 and step 70 comprise a normally closed switch positioned at the end of key slot 18. On the free end of wiper 54 is fixedly secured a head 72 of ferromagnetic material such as soft iron. The wiper 54, is bent in leaf spring fashion with the head 72 contacting step 70 behind wiper 54. When the appropriate magnet-bearing key 20 is inserted into key slot 18, the head 72 is attracted by magnet 28 and pulled away from step 70.

It should be apparent that when a non-magnet-bearing key is inserted into key slot 18, the switch wiper 52 is pushed into contact with step 68 and the switch wiper 54 retains its normal condition of contact with step 70. In that event, there is continuity between leads 56 and 58 through the two switch wipers and the metal body 30. This continuity, completes a series circuit between battery 44 and alarm 46 to energize the alarm indicating an improper attempt to open lock 10.

Having described the preferred embodiment of the present invention in great detail it should be understood that numerous modifications, additions and omissions in the details thereof are possible within the intended spirit and scope of the invention as indicated by the following claims.

What is claimed is:

1. A battery operated alarm system responsive to a serrated magnet-bearing key comprising a tumbler assembly having a key slot for cooperation with the serrations of said key, a first switch means carried by said lock for detecting the presence of a key in said key slot, a second switch means including ferromagnetic material for magnetic actuation of said second switch means by said key, a battery holder and an alarm means carried by said lock and means for interconnecting said battery, said alarm and said first and second switch means for said alarm to be energized upon insertion of a non-magnet-bearing key.

2. The system of claim 1 wherein said second switch means comprises a normally closed switch having a wiper element communicating with said key slot said wiper element carrying said ferromagnetic material in a position for said material to be attracted by said magnet-bearing key when inserted in said key slot for opening said normally closed switch.

3. The system of claim 2 wherein said first switch means is a normally open switch electrically connected in series with said second switch means, said normally open switch including an actuating element projecting into said key slot for contacting said key.

* * * * *